US007842113B2

(12) United States Patent
Albrecht et al.

(10) Patent No.: US 7,842,113 B2
(45) Date of Patent: Nov. 30, 2010

(54) EXTENDED WATER LEVEL RANGE STEAM/WATER CONICAL CYCLONE SEPARATOR

(75) Inventors: Melvin John Albrecht, Homeworth, OH (US); Eric Lynn Wells, Massillon, OH (US); David Lee Glover, Medina, OH (US)

(73) Assignee: Babcock & Wilcox Power Generation Group, Inc.

( * ) Notice: Subject to any disclaimer, the term of this patent is extended or adjusted under 35 U.S.C. 154(b) by 547 days.

(21) Appl. No.: 11/857,898

(22) Filed: Sep. 19, 2007

(65) Prior Publication Data

US 2008/0069646 A1 Mar. 20, 2008

(51) Int. Cl.
*B01D 45/12* (2006.01)

(52) U.S. Cl. ..... 55/348; 55/349; 55/423; 55/426; 55/456; 55/457

(58) Field of Classification Search ..... 55/424, 55/426, 447, 448, 449, 450, 452, 456, 457, 55/458, 459.1, 459.2, 459.3, 459.4, 342, 55/348, 349, 423; 96/301; 261/79.1; 239/461
See application file for complete search history.

(56) References Cited

U.S. PATENT DOCUMENTS

| | | | | |
|---|---|---|---|---|
| 418,834 | A | 1/1890 | Arlington et al. | |
| 2,271,634 | A | 2/1942 | Fletcher et al. | |
| 2,293,740 | A | 8/1942 | Kooistra | |
| 2,298,285 | A | 10/1942 | Fletcher | |
| 2,321,628 | A | 6/1943 | Rowand et al. | |
| 2,346,672 | A | 4/1944 | Fletcher | |
| 2,395,855 | A | 3/1946 | Fletcher | |
| 2,402,154 | A | 6/1946 | Fletcher | |
| 2,434,637 | A | 1/1948 | Brister | |
| 2,434,663 | A | 1/1948 | Letvin | |
| 2,434,677 | A | 1/1948 | Stillman | |
| 2,532,332 | A | 12/1950 | Rowand | |
| 2,594,490 | A * | 4/1952 | Patterson | 55/323 |
| 2,648,397 | A * | 8/1953 | Ravese et al. | 55/343 |
| 2,732,028 | A | 1/1956 | Coulter | |
| 2,739,663 | A * | 3/1956 | Gurney | 95/291 |
| 2,763,245 | A * | 9/1956 | Place | 122/488 |
| 2,782,772 | A * | 2/1957 | Blaser | 122/406.1 |
| 2,822,060 | A * | 2/1958 | Udovich | 55/459.1 |

(Continued)

OTHER PUBLICATIONS

Steam/its generation and use, 1972, pp. 1-5-1-9, 38th Edition, Babcock & Wilcox, New York, NY, USA.

(Continued)

*Primary Examiner*—Duane Smith
*Assistant Examiner*—Sonji Turner
(74) *Attorney, Agent, or Firm*—Eric Marich

(57) ABSTRACT

An extended water level range steam/water conical cyclone separator for separating steam from water in a steam/water mixture supplied to a steam drum of a boiler, has a housing comprising a conical portion with upper and lower cylindrical portions, and a conical vane plate. An open bottom extension sleeve portion for discharging water from the steam/water conical cyclone separator housing and connected to the lower cylindrical water outlet portion is provided such that the conical vane plate is located at an intermediate location between the upper conical portion and the open bottom extension sleeve portion of the lower cylindrical portion. Extended water level range capability is thus provided while maintaining adequate steam/water cyclone separator performance characteristics.

10 Claims, 10 Drawing Sheets

U.S. PATENT DOCUMENTS

| | | | | | |
|---|---|---|---|---|---|
| 2,846,024 | A | * | 8/1958 | Bremi | 55/413 |
| 2,891,632 | A | | 6/1959 | Coulter | |
| 2,895,566 | A | * | 7/1959 | Coulter | 95/213 |
| 3,014,553 | A | * | 12/1961 | Jerman et al. | 96/212 |
| 3,165,387 | A | * | 1/1965 | Place | 95/211 |
| 3,393,496 | A | * | 7/1968 | Worley et al. | 55/349 |
| 3,435,598 | A | * | 4/1969 | Coulter et al. | 55/424 |
| 3,675,401 | A | * | 7/1972 | Cordes | 55/394 |
| 3,755,996 | A | * | 9/1973 | Klein et al. | 55/459.1 |
| 3,822,533 | A | * | 7/1974 | Oranje | 55/394 |
| 3,885,933 | A | | 5/1975 | Putney | |
| 3,988,132 | A | * | 10/1976 | Oranje | 55/399 |
| 4,077,362 | A | * | 3/1978 | Hawkins | 122/491 |
| 4,483,696 | A | * | 11/1984 | Zipay et al. | 96/190 |
| 4,509,965 | A | * | 4/1985 | Morton | 55/399 |
| 4,565,554 | A | * | 1/1986 | Zipay et al. | 96/189 |
| 4,602,925 | A | * | 7/1986 | Huffman | 55/457 |
| 4,629,481 | A | * | 12/1986 | Echols | 55/348 |
| 4,783,204 | A | * | 11/1988 | Roarty | 95/269 |
| 4,848,991 | A | | 7/1989 | Bielefeldt | |
| 4,927,298 | A | | 5/1990 | Tuszko et al. | |
| 5,033,915 | A | | 7/1991 | Albrecht | |
| 5,771,844 | A | * | 6/1998 | Dietz | 122/4 D |
| 6,214,220 | B1 | * | 4/2001 | Favret, Jr. | 210/188 |
| 7,381,235 | B2 | * | 6/2008 | Koene et al. | 55/394 |

OTHER PUBLICATIONS

Kitto et al., Steam/its generation and use, 2005, pp. 5-13-5-17, 41st Edition, The Babcock & Wilcox Company, Barberton, OH, USA.

* cited by examiner

EXTENDED WATER LEVEL RANGE STEAM/WATER CONICAL CYCLONE SEPARATOR

FIELD AND BACKGROUND OF THE INVENTION

The present invention relates, in general, to cyclone separators for separating steam from steam/water mixtures, such as in a steam drum of a boiler.

Steam/water mixtures are commonly produced by boilers used in the industrial processes such as the pulp and paper industry, and in the utility power generation industry. The separated steam may be used for process heating or other applications known in these industrial applications, or it may be used as the driving force of steam turbine generators used in electrical power generation. For additional information concerning steam/water cyclone separators as employed in steam drums, the industrial or utility power generation settings in which they may be applied, the reader is referred to *Steam/its generation and use,* 41st Edition, Kitto and Stultz, Editors, Copyright© 2005, The Babcock & Wilcox Company.

Various types of devices have been developed to separate steam from steam/water mixtures. The following discussion is merely intended to be illustrative of some of these developments.

U.S. Pat. No. 2,271,634 to Fletcher discloses a cylindrical cyclone separator having a circular whirl chamber, a tangential inlet, a central steam outlet located at the top of the circular whirl chamber, and a water outlet located at the bottom of the whirl chamber. To prevent water from being discharged through the steam outlet, means are provided for increasing the downward component of the incoming stream of steam and water mixture. This means is a segmented plate having downwardly and rearwardly inclined edges that causes the incoming steam and water mixture to be deflected downwardly towards the water outlet of the separator.

U.S. Pat. No. 2,293,740 to Kooistra discloses a similarly designed cyclone separator that does not utilize the segmented plate but rather employs a bottom cup at the bottom of the whirl chamber which confines the steam to the upper portion of the whirl chamber and prevents it from passing down into the separated water as it discharges from the whirl chamber, into the drum.

U.S. Pat. No. 2,298,285 to Fletcher discloses another variation of the cylindrical cyclone separator this time employing a rim or cap on top of the cyclone separator steam outlet together with the segmented plate. The rim acts to enhance separation of water and reduction of pressure drop in the separator.

U.S. Pat. No. 2,321,628 to Rowand et al. discloses a cyclone separator which is similar to the present application. The circulator whirl chamber in this reference is the frustum of a cone at the upper portion and substantially cylindrical at the lower portion where the water is discharged. Again, a tangential inlet is employed to deliver the steam water mixture into the cyclone separator, and is of a vertical extent substantially equal to that of the tapered portion of the whirl chamber. The tapered configuration acts to direct the entering steam water mixture into a slightly downward direction to prevent upward spread of the deflected water and enhance separation of the steam therefrom.

U.S. Pat. No. 2,346,672 to Fletcher discloses a substantially cylindrical cyclone separator this time having instead of a tangential inlet a large steam/water inlet which extends over a large fraction of the perimeter of the cyclone separator. As indicated in the reference, the inlet can extend to approximately ⅓ of the perimeter of the cyclone separator to provide adequate flow capacities. One object is to produce a separator or densifier which operates effectively with low pressure drop so that it can be advantageously used where only a small pressure head is available.

U.S. Pat. No. 2,395,855, to Fletcher discloses a substantially cylindrical cyclone separator having a tangential inlet and where the steam outlet center is located eccentric of the whirl chamber center to effect enhanced separation of steam from the water. This design also employs the segmented plate seen in the previously described patents.

U.S. Pat. No. 2,402,154 to Fletcher and the aforementioned U.S. Pat. No. 2,395,855 are both divisionals of the same application. The U.S. Pat. No. 2,395,855 is drawn to the particular type of fluid separator itself; while the U.S. Pat. No. 2,402,154 is drawn to the combination of this device in a steam generator.

U.S. Pat. No. 2,434,637 to Brister, U.S. Pat. No. 2,434,663 to Letvin and U.S. Pat. No. 2,434,677 to Stillman are all drawn to various aspects of the perforated cone used at the top of the cyclone separator to enhance separation of the steam from the water.

U.S. Pat. No. 2,532,332 to Rowand is drawn to the particular construction of the separators which today are generally considered as secondary scrubbers.

U.S. Pat. No. 2,732,028 to Coulter is also drawn to a cyclone separator device very similar to that employed at this time. The cyclone separator has the aforementioned frustoconical upper section and generally cylindrical lower section with a tangential steam water inlet located on the side of the frustoconical section. The overall emphasis of this reference is drawn to means of simplifying the construction for accessibility and repair of the elements located in the steam drum. This is accomplished by dividing the steam space in the drum into separate compartments, one or more of which are open to the water space of the drum into the necessary drum safety valves while one or more of the other compartments are open to the steam and water separators of the drum the saturated steam outlets. Partitions are used to accomplish this division and they are effective in maintaining the separation of the drum components during normal operation but are easily broken when the safety valves are opened.

U.S. Pat. No. 2,891,632 to Coulter is drawn to a cyclone steam separator quite similar to that disclosed in the earlier mentioned Fletcher patent (U.S. Pat. No. 2,346,672) with the exception that instead of the steam water inlet being located only approximately along ⅓ of the circumference of the separator, this cyclone separator has the entire circumference provided with an array of vanes that "slice" the incoming steam water mixture into thin sheets to enhance separation of the steam from the water.

U.S. Pat. No. 5,033,915 to Albrecht is drawn to a cyclone steam separator quite similar to that disclosed at this time. The cyclone separator is a modified version of the standard conical cyclone separator that provides a lower pressure drop than the standard conical cyclone for an equivalent number of or an equivalent steam capacity of the separators. The major modification of this separator is that the cyclone separator's tangential inlet has been lengthened by 3 inches. This increase in length increases the cyclone inlet flow area by 28%.

In the late 1980's and early 1990's, The Babcock & Wilcox Company (B&W) performed several steam/water conical cyclone separator tests in order to find ways to improve the performance of the standard conical cyclone separator, particularly ways to increase the separation capacity of the separator without adversely increasing the pressure drop through the cyclone separator. The standard conical cyclone separator 10 is shown in FIG. 1. As part of these tests, the effect of extending the length of the cyclone separator was investigated. It was known that the separation performance and pressure drop through the separator was affected by the design and location of the conical vane bottom plate that is typically located at the inside of the lower conical portion of the separator.

Referring to FIG. 1, the conical steam/water conical separator or separator 10 which may be mounted within a steam drum (see FIG. 10, infra) and having a housing which has an upper conical portion 12 and a lower cylindrical portion 14. A steam/water inlet 16 having an axial length provides a means for introducing a steam/water mixture tangentially into the upper conical portion of the separator 10. The steam/water mixture is separated into steam and water by swirling the mixture at high velocity around the interior of the separator 10. The greater mass of the water causes it to move to the outside of the swirling stream leaving a concentration of steam in the central portion. The steam is discharged through an upper cylindrical outlet 17. If desired, the separated steam discharged through outlet 17 may be further treated by conventional scrubbers and other equipment (see FIG. 10, infra) to remove water droplets which may still be present. The water which has been removed from the mixture is discharged from the separator 10 through a lower cylindrical portion 14 and a ring shaped, conical vane plate 18 located at the bottom of the separator 10. The separator 10 has an overall axial length of about 20".

The above basic description of the operation of a steam/water conical cyclone separator generally applies to other steam/water conical cyclone separators described in the balance of the present disclosure.

As part of the testing, it was discovered that the length of the cyclone separator 10 could be increased by up to an additional 6 to 8 inches with the conical vane plate 18 remaining at the bottom of the cyclone separator 10. This is accomplished by making the cylindrical portion 14' 6 to 8 inches longer, and this separator 20 is shown in FIG. 2. Separator 20 thus has an overall axial length of about 28 inches. The surprising results from the testing of the extended length separator 20 with the longer cylindrical portion 14' were that the performance and pressure drop aspects of the separator 20 were maintained or equivalent to the standard conical cyclone separator 10. See FIGS. 3, 4 and 5.

The steam/water conical cyclone separator 30 of Albrecht is shown in FIG. 6. One difference between the separator 30 and the separators 10 and 20 is that the steam/water inlet of separator 30, designated 16', partially extends into the lower cylindrical portion 14, with an overall length also about 3" longer in the cylindrical portion than the separator of FIG. 1. Similar performance and pressure drop results to those described in the paragraph immediately above were also observed when an extended length lower cylindrical portion 14' was applied to that type of cyclone separator design; see FIG. 7. The separator of FIG. 7 has an overall length of about 28 inches.

As mentioned above, the main purpose of the testing that was done in the late 1980's and early 1990's was to obtain a lower pressure drop cyclone separator. However, there was also a need to gain an understanding of the effects of extending the length of the separator and the importance of the location of the conical vane plate 18. Since the market at the time was requiring larger water volumes in the steam drum, the lengthening of the cyclone separator was a very valuable technique for increasing the water inventory in the steam drum without increasing the diameter of the steam drum. The question that the testing investigated was the importance of the location of the conical vane plate 18 when the cyclone separator was extended. By increasing the overall length of the cyclone, the location of the conical vane plate 18 was considered to be a very important component of the separator design that strongly affected the performance and separation efficiency of the separator. This was the conclusion that was reached in past cyclone separator studies that were done before the 1980's (some of which go back to the 1930's and this knowledge has been passed down through technical discussions rather than through documented results). So if the conical vane plate was positioned at a different location than what the separator of FIG. 1 used, the performance of the separator was questioned. Since the testing showed basically no difference, the FIG. 2 and FIG. 7 cyclone separators were developed and offered as boiler components for B&W steam drums. However, the performance results of placing the conical vane plate in a cyclone separator where the separator length is increased by more than six inches are uncertain. To the best of the present inventors' knowledge, no B&W steam/water conical cyclone separators have utilized only an open additional length conical extension on the bottom of the conical cyclone separator. All extended length cyclone separators have incorporated the conical vane plate at the bottom of the separator.

SUMMARY OF THE INVENTION

Based upon test results, it has been determined that the performance and efficiency of the steam/water conical separator is set by the location of the bottom conical vane plate and that no more than a 6 inch extension of the separator should be considered.

Accordingly, one aspect of the present invention is drawn to a modified extended length steam/water conical cyclone separator which can be used in applications that require a larger than normal operating range of water level within the steam drum. The separator according to the present invention can incorporated into steam drums that have inside diameters that are greater than 66 inches. The new separator according to the present invention is developed from the current 11½ inch ID conical cyclone separators designed and manufactured by The Babcock & Wilcox Company which can have either the current inlet or low pressure drop inlet designs. The benefits of the new extended range conical cyclone separator according to the present invention is that larger water holding capacities can be achieved without sacrificing the performance aspects of the separator designs. The extended length steam/water conical cyclone separator of the present invention can be applied in steam drums used in various settings such as, by way of example and not limitation, industrial or utility steam generators, boilers used in the pulp and paper industry, Heat Recovery Steam Generators (HRSGs), radiant syngas cooler boiler designs or any other type of boiler design that requires an extended water level operating range within a steam drum or other vessel used for separation of steam from water. The length of the extension is determined by the range of operating water level within the steam drum.

The extended length steam/water conical cyclone separator according to the present invention does not require the conical vane plate to be located at the bottom of the separator.

Another aspect of the present invention is drawn to a steam drum employing a plurality of the modified extended length steam/water conical cyclone separators according to the present invention.

Yet another aspect of the present invention is drawn to an extended length steam/water conical cyclone separator which is provided with a cylindrical extension below the conical vane plate which incorporates holes so that the pressure drop characteristics of the conical vane plate are maintained. The holes can be provided at one or more spaced elevations or intervals along the length of the extension.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENT

Figure 1:
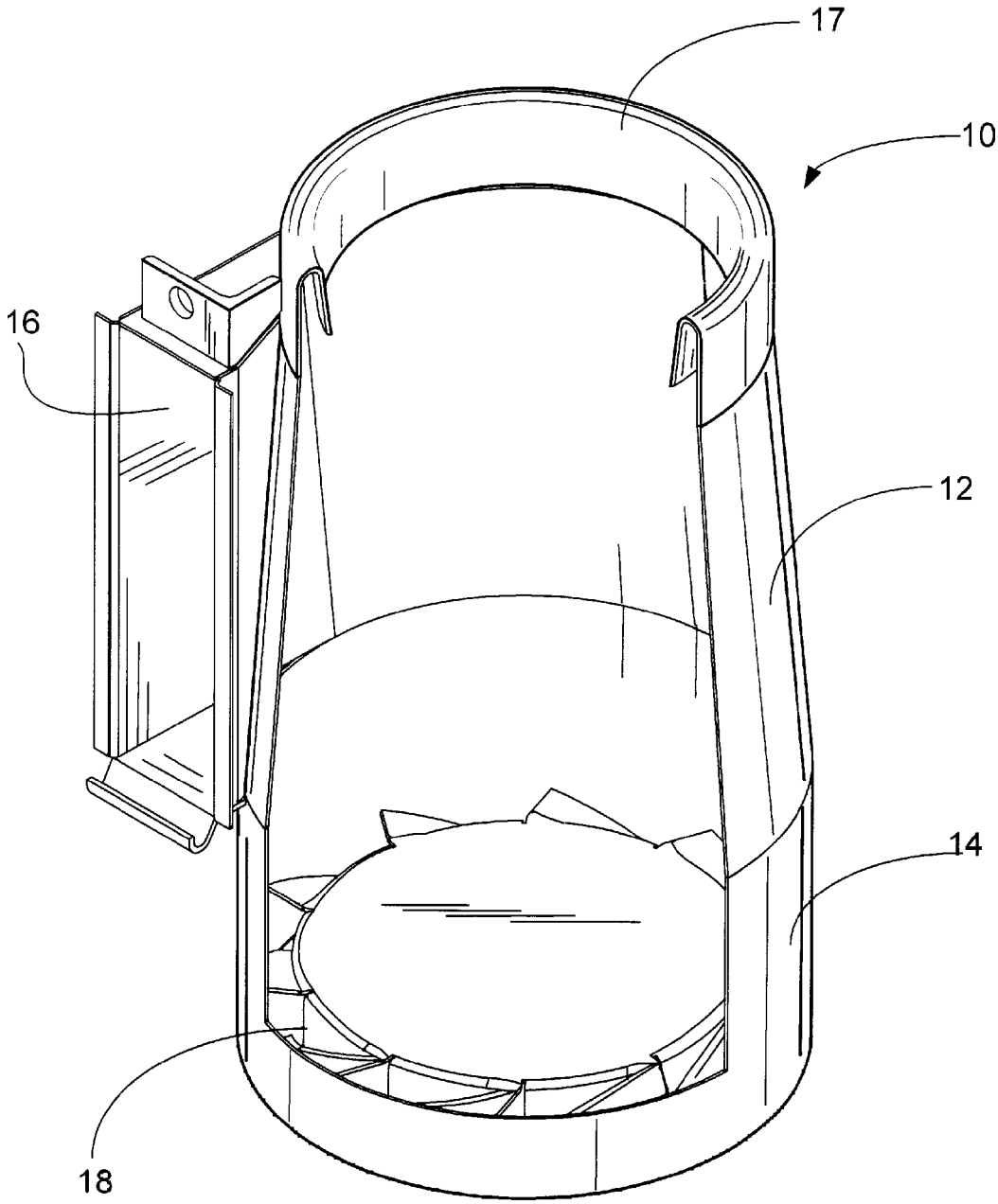
FIG. 1 PRIOR ART
FIG. 1 is a perspective illustration of a known conical cyclone separator, having a conical vane plate located at the bottom of the lower cylindrical water outlet.
Figure 2:
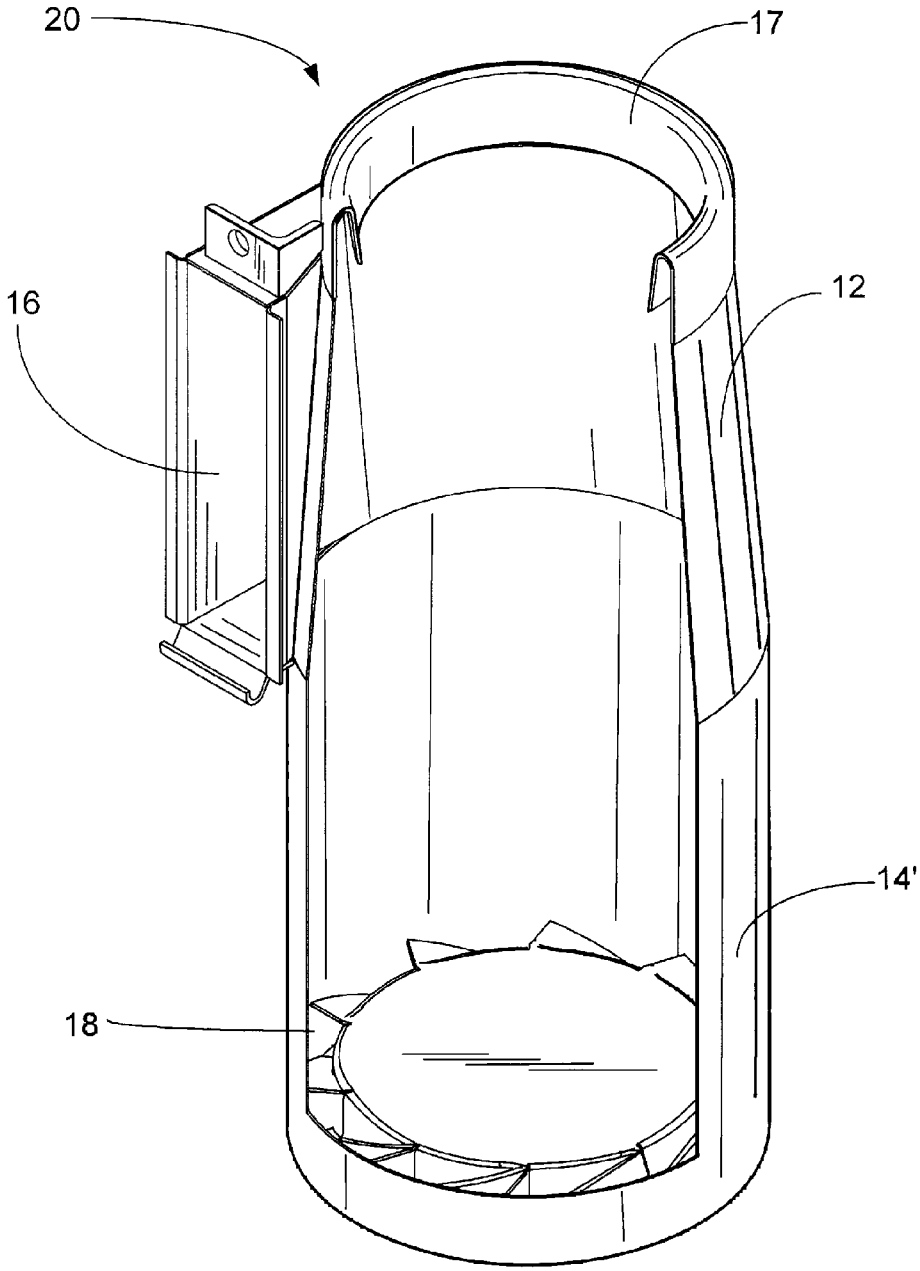
FIG. 2 PRIOR ART
FIG. 2 is a perspective illustration of another known conical cyclone separator, similar to that shown in FIG. 1, and having a conical vane plate located at the bottom of the lower cylindrical water outlet but with a longer cylindrical portion between the upper conical portion and the conical vane plate.
Figure 3:
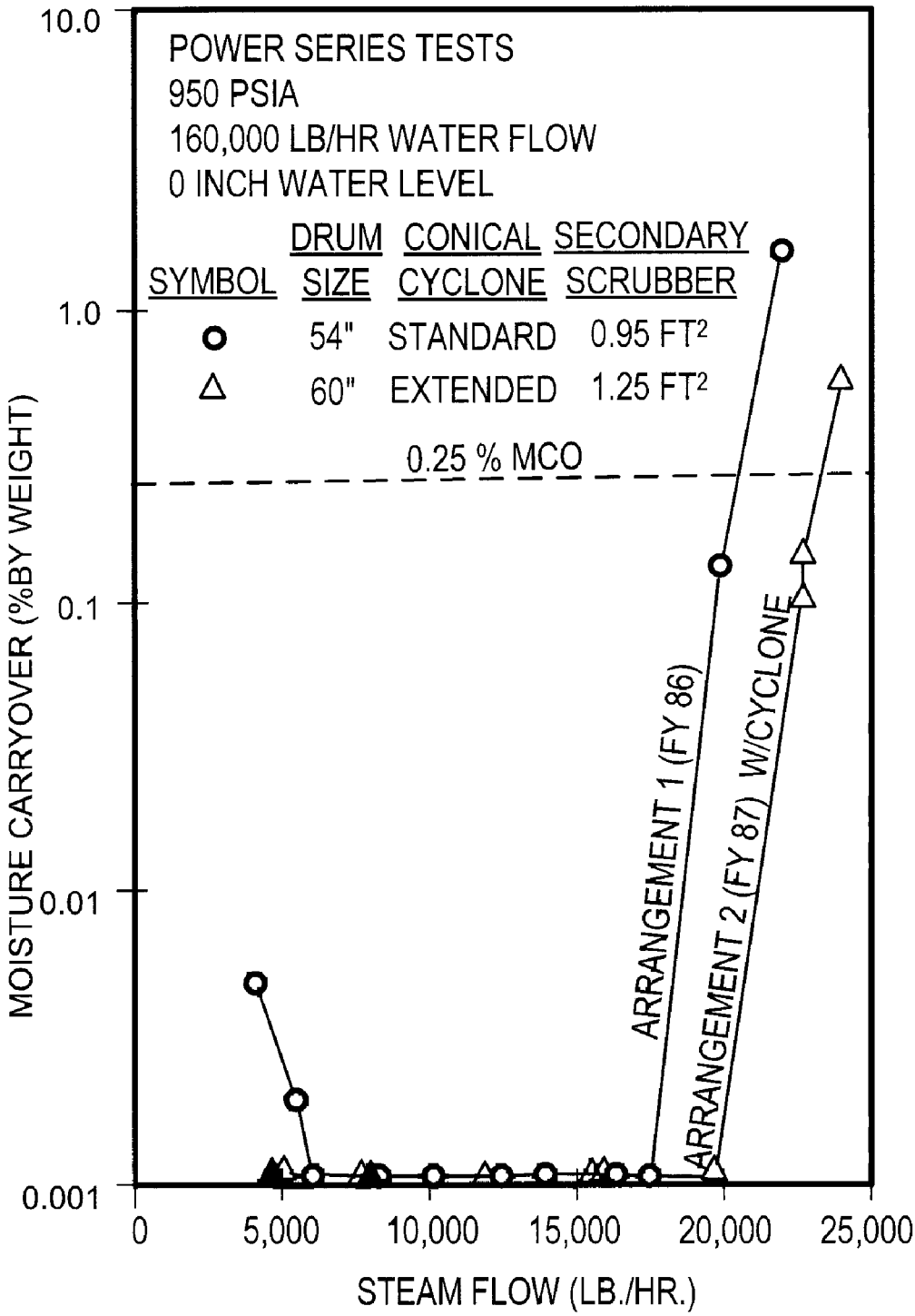
FIG. 3 is a graph showing moisture carryover versus steam flow for the conical cyclone separator of FIG. 1 and the conical cyclone separator of FIG. 2.
Figure 4:
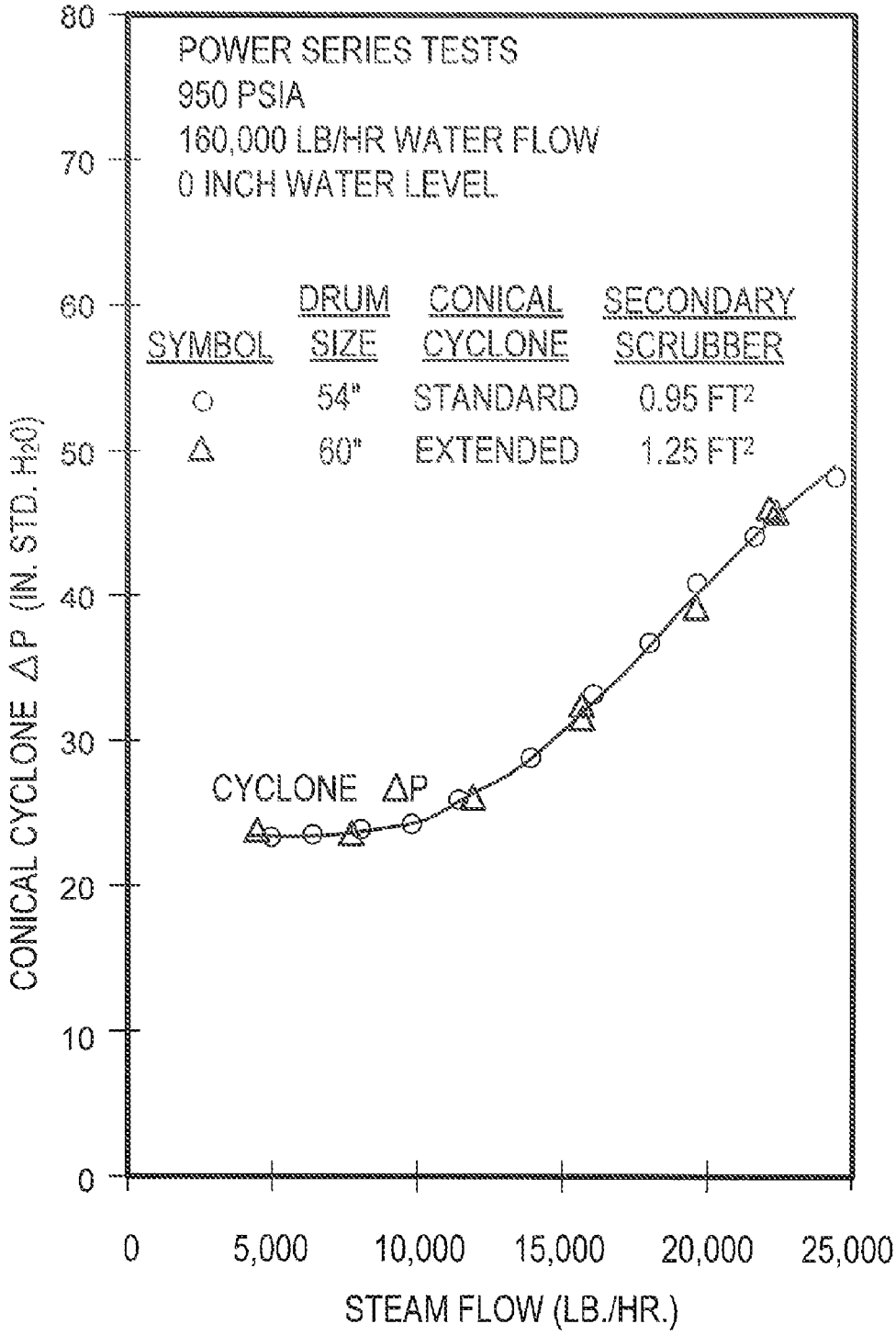
FIG. 4 is a graph showing conical cyclone pressure drop versus steam flow for the conical cyclone separator of FIG. 1 and the conical cyclone separator of FIG. 2.
Figure 5:
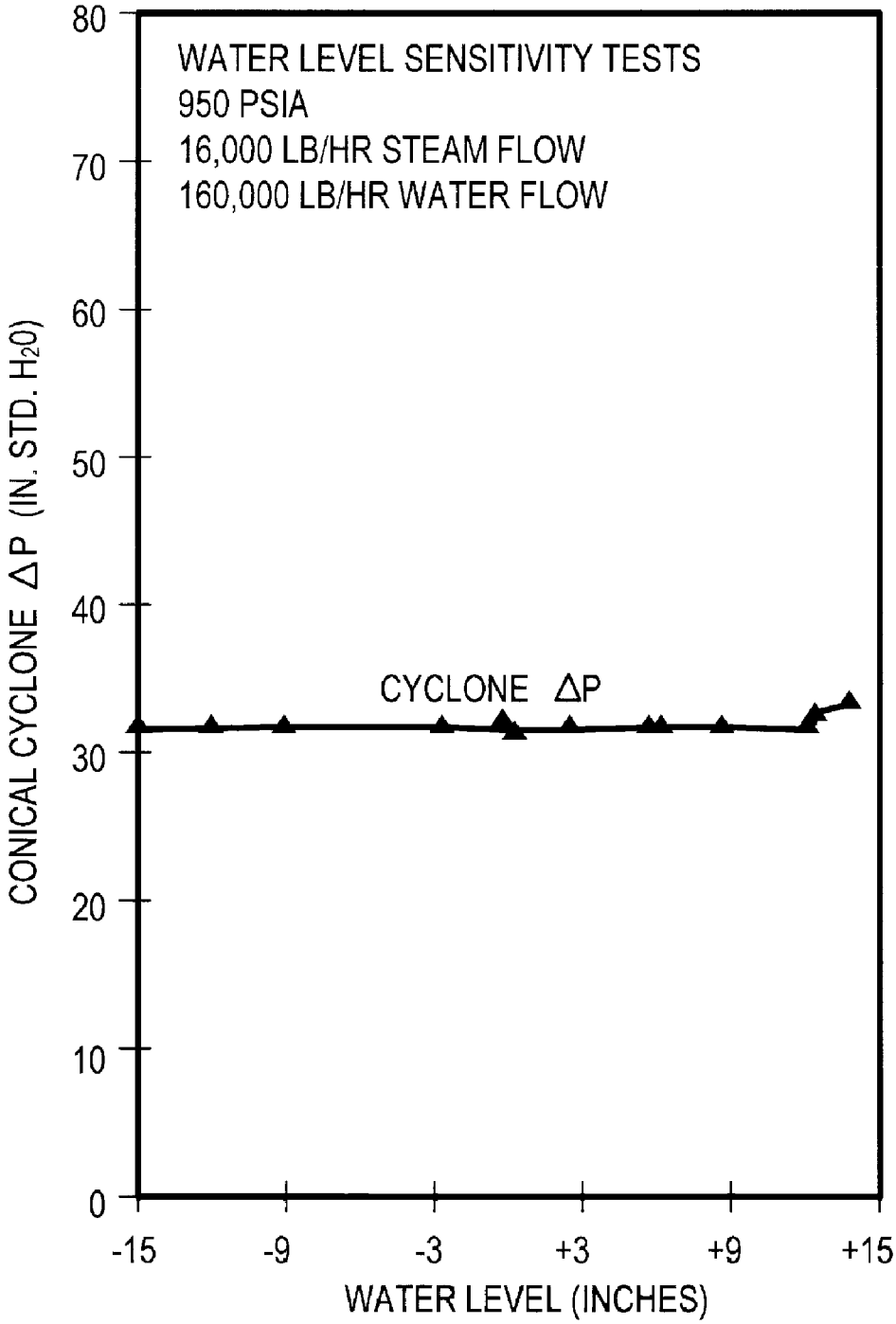
FIG. 5 is a graph showing moisture carryover versus water level for the conical cyclone separator of FIG. 1 and the conical cyclone separator of FIG. 2.
Figure 6:
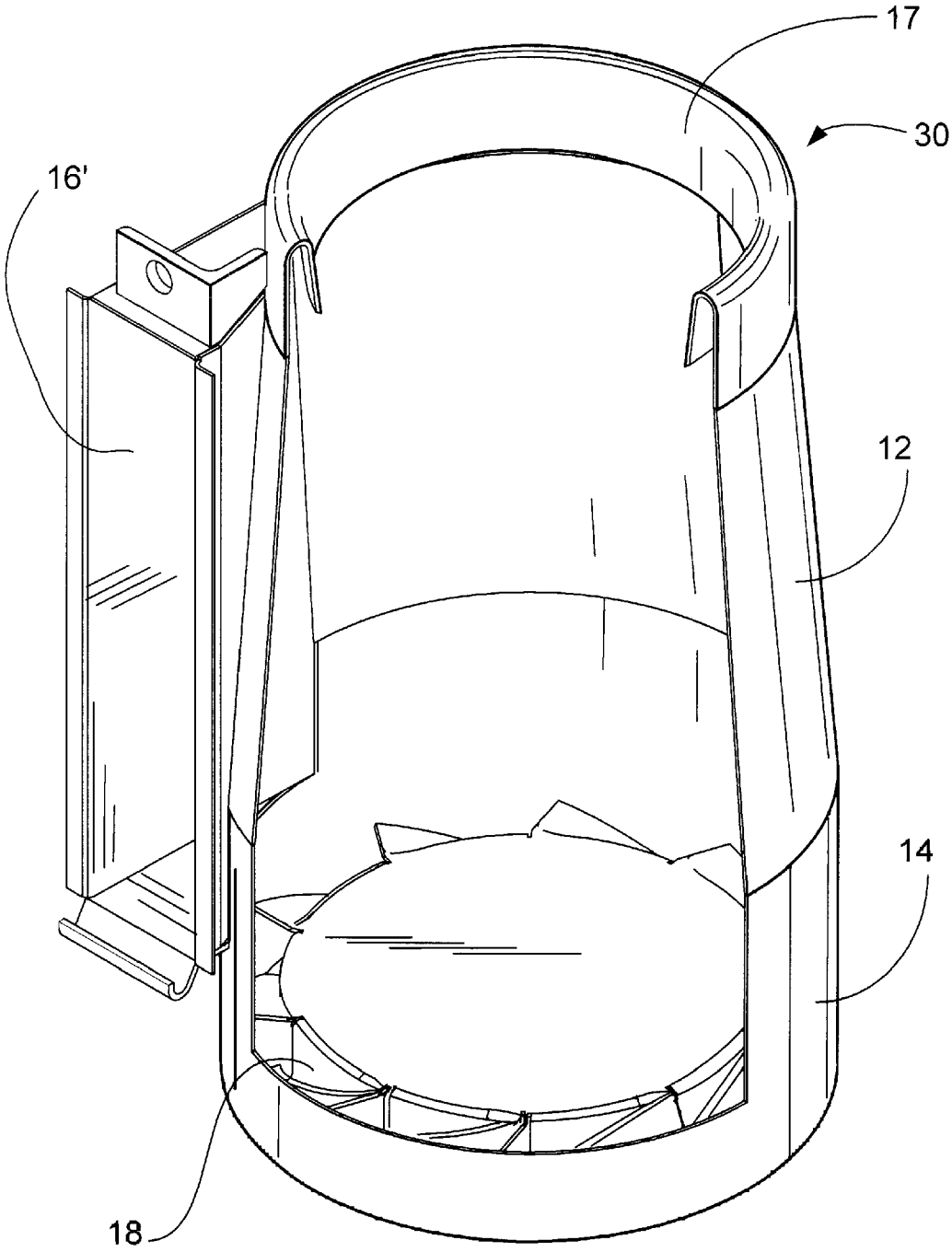
FIG. 6 PRIOR ART
FIG. 6 is a perspective illustration of another known conical cyclone separator, wherein the steam/water inlet partially extends into the cylindrical portion, and having a conical vane plate located at the bottom of the lower cylindrical water outlet.
Figure 7:
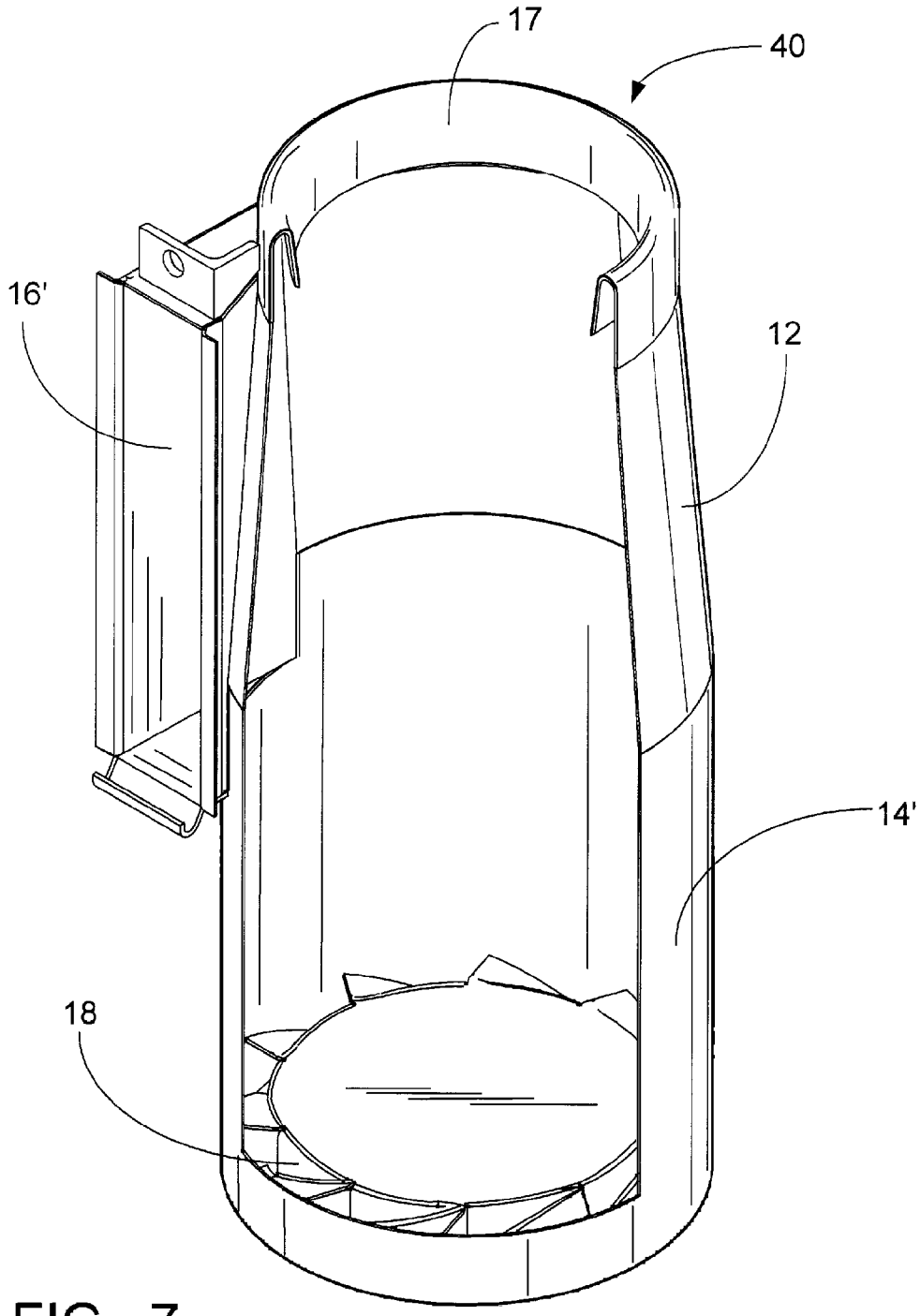
FIG. 7 PRIOR ART
FIG. 7 is a perspective illustration of another known conical cyclone separator, wherein the steam/water inlet partially extends into the cylindrical portion, and having a conical vane plate located at the bottom of the lower cylindrical water outlet but with a longer cylindrical portion between the upper conical portion and the conical vane plate.
Figure 8:
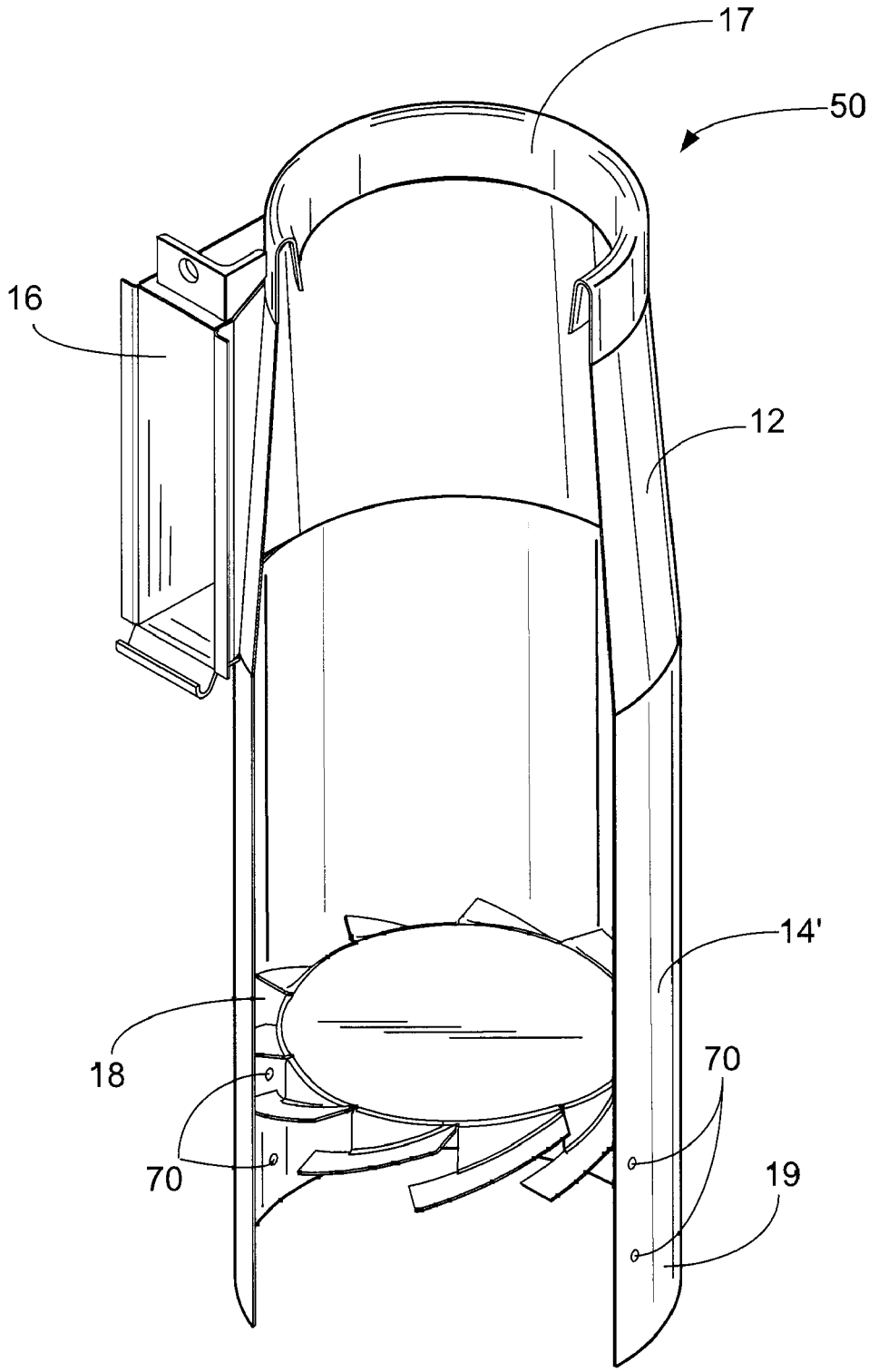
FIG. 8 is a perspective illustration of a first embodiment of the extended water level range conical cyclone separator according to the present invention, having a steam/water inlet which extends only into the conical portion, a conical vane plate, and an extension sleeve portion located below the conical vane plate whereby the conical vane plate is located at an intermediate location between the upper conical portion and the bottom of the lower cylindrical water outlet.

Referring to the drawings generally, wherein like reference numerals designate the same or functionally similar elements throughout the several drawings, and to FIG. 8 in particular, there is illustrated a first embodiment of the extended water level range steam/water conical cyclone separator, generally designated 50. The present invention incorporates the use of an open bottom cylindrical extension sleeve portion 19 that is attached to the current extended length cyclone separators having the lower cylindrical portion 14', such as those illustrated in FIGS. 2 and 7. In this design, the conical vane plate 18 will remain at the normal location that was established for the current extended length cyclone separators (FIG. 2, and FIG. 7). By this positioning of the conical vane plate 18 with respect to the extension sleeve portion 19, the conical vane plate is located at an intermediate location between the upper conical portion 12 and the bottom of the lower cylindrical portion 14', which is now the open bottom portion of the extension sleeve 19. The open bottom extension sleeve 19 allows the new separator's length to be increased while maintaining the performance of the separator designs, 20, 40. The extension sleeve 19 increases the overall length of the separator 50 so that the steam drum's operating water level range can be extended to the maximum high and low variations that are functions of the size of the steam drum. Therefore, for HRSG, radiant syngas cooler or any other boiler applications, the water holding capacity of the steam drum can be maximized.

Figure 9:
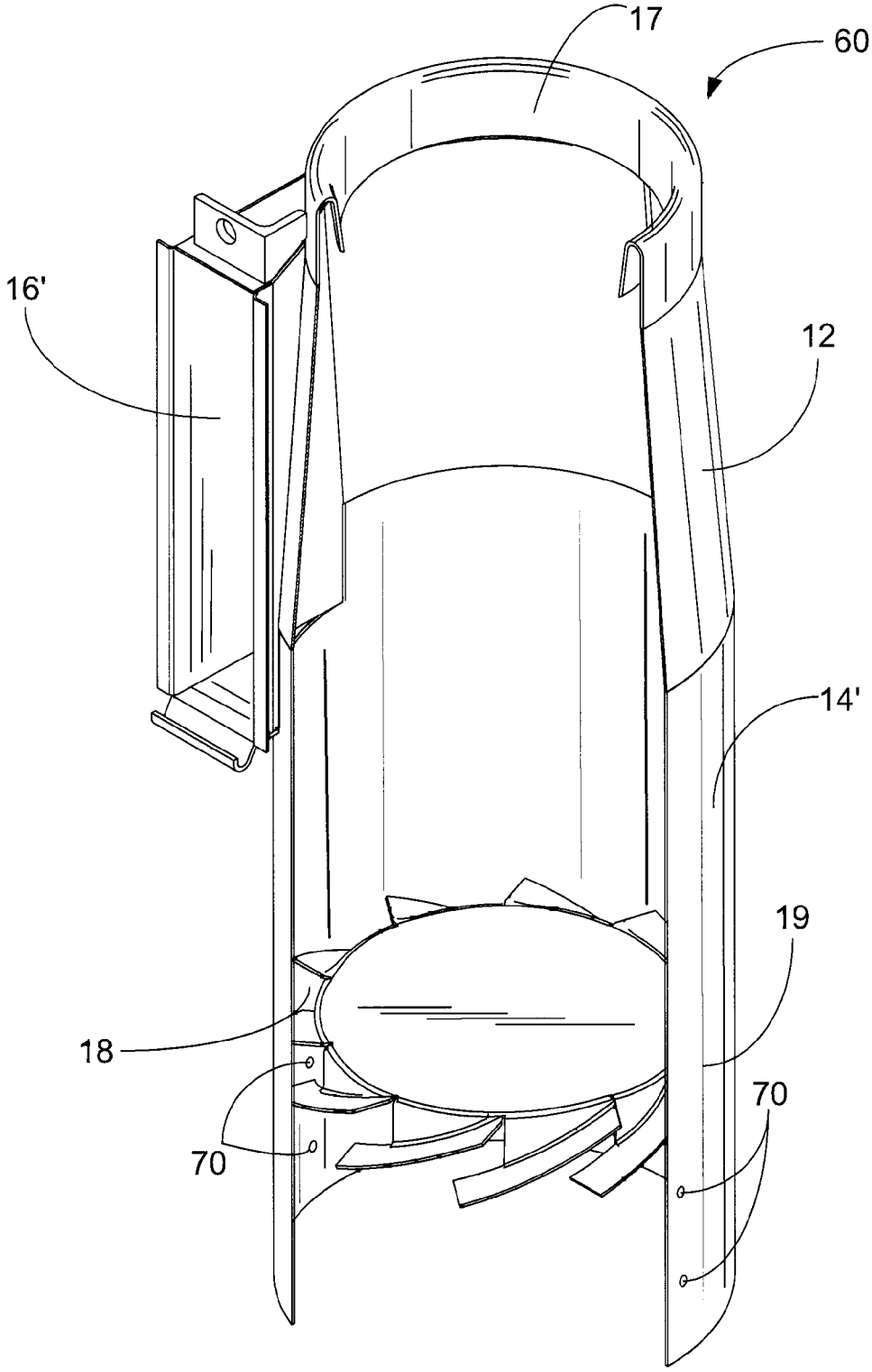
FIG. 9 is a perspective illustration of a second embodiment of the extended water level range conical cyclone separator according to the present invention, having a steam/water inlet which partially extends into the cylindrical portion, a conical vane plate, and an extension sleeve portion located below the conical vane plate whereby the conical vane plate is located at an intermediate location between the upper conical portion and the bottom of the lower cylindrical water outlet.

Graphical views showing the new extended length cyclone separator are shown in FIG. 8, (with 6 inch extension) and in FIG. 9, separator 60, (with 6 inch extension). These new steam/water conical cyclone separators 50, 60 maintain the conical vane plate 18 at the same location as the aforementioned separators, 20, 40, respectively, and have an overall length of about 34 inches. By locating the conical vane plate 18 at these locations, the pressure drop characteristics that the conical vane plate 18 provides to the separator 50, 60 helps to maintain the performance and separation efficiency of the separator 50, 60 across the larger water level range of the steam drum. The cylindrical extension sleeve 19 that is used below the conical vane plate 18 could also incorporate a few small holes or apertures 70 (schematically indicated in FIGS. 8 and 9) so that the pressure drop characteristics of the conical vane plate 18 are maintained for very large diameter steam drums (greater than 70 inches ID) where the water level hydrostatic head does not influence the pressure drop characteristics across the conical vane plate 18. Preferably a minimum of four holes 70 that are about ¼" to no larger than about ½" would be evenly distributed around the upper portion of the cyclone separator extension sleeve 19, but below the location of the conical vane plate 18. In cases where a long (e.g., greater than 1 ft.) cylindrical cyclone separator extension sleeve 19 is used, these holes 70 would also be spaced along the length of the cylindrical cyclone separator extension sleeve 19 spaced at about even intervals and no farther than 6" apart.

The incorporation of the holes 70 in the conical cyclone separator extension portion 19 helps to reduce the pressure differential across the cyclone separator conical vane plate 18. When the cyclone separator 50, 60 is experiencing either very high or very low water levels in the steam drum, these holes 70 help to reduce the hydrostatic pressure head at the conical cyclone separator vane plate 18. This feature allows the conical cyclone separator 50, 60 to perform with similar performance as a cyclone separator without the extension portion 19.

Figure 10:
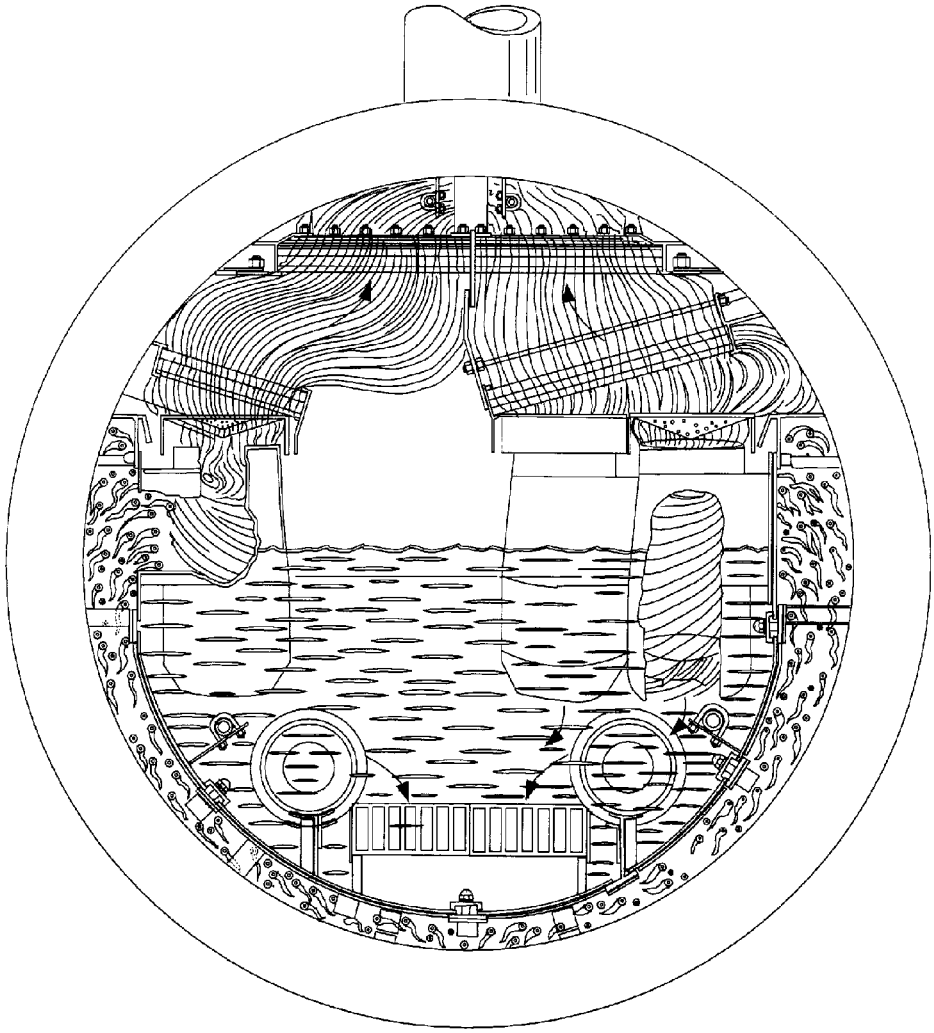
FIG. 10 is a cross-sectional view of a conventional steam drum, in this case employing three rows of cyclone separators, to which the improved steam/water conical cyclone separator according to the present invention could be applied.

FIG. 10 illustrates a cross-sectional view of a conventional steam drum 100, taken from the aforementioned Steam 41st reference text, in this case employing three rows of cyclone separators 110, to which the improved steam/water conical cyclone separator according to the present invention could be applied. As will be appreciated by those skilled in the art, the drum inside diameter would be increased to accommodate the extended length of the steam/water conical cyclone separator 50, 60 of the invention.

The present invention has several advantages, including the benefit that its use will result in a shorter length drum for applications that require longer than normal water holding times. For special applications, a customer could require that the drum contain a set amount of water for special transient or load restraints. This amount of water is required to protect the boiler from tube overheating during a transient and/or special operational event where the feedwater system fails to provide sufficient water (such as a black plant, load excursion, etc.). In sizing the steam drum for a large amount of water inventory, a larger diameter drum with a short length could be more economical than a smaller diameter drum with a longer length; therefore the benefits of this new idea are important for maintaining steam drum performance while increasing the water level range and water level inventory of the drum.

The improved steam/water conical cyclone separator according to the present invention maintains the performance and pressure drop characteristics of the current cyclone separator designs while increasing the water level range and water holding capacity of the steam drum. The only alternative to meet the water holding capacity for a specific boiler design would be to use a normal size steam drum that is much longer than the steam drum that could be designed utilizing the extended range conical cyclone separator.

According to the present invention, thus a relatively simple modification yields substantially improved results in an unexpected manner.

While a specific embodiment of the invention has been shown and described in detail to illustrate the application of the principles of the invention, it will be understood that the invention may be embodied otherwise without departing from such principles. For example, the present invention can be applied to new steam drum construction or to the repair, replacement and modification or retrofitting of existing steam drums, provided sufficient drum internal diameter is available. Further, certain features of the invention may be advantageously employed without a corresponding use of other features. Accordingly, all such variations and modifications of the present invention will be readily apparent to those skilled in the art and the present invention is intended to cover in the appended claims all such modifications and equivalents covered by the scope of the following claims.

We claim:

1. A cyclone separator for separating steam from water in a steam/water mixture, comprising:

a separator housing having a conical portion and an upper cylindrical steam outlet portion connected to the conical portion that forms a central opening for discharging steam from the separator;

a lower cylindrical water outlet portion connected to the conical portion and having a conical vane plate;

an axially elongated steam/water mixture inlet connected tangentially to the conical portion of the housing; and an open bottom extension sleeve portion for discharging water from the housing that is connected to the lower cylindrical water outlet portion such that the conical vane plate is located at an intermediate location between the conical portion and the open bottom extension sleeve portion of the lower cylindrical water outlet portion.

2. The cyclone separator according to claim 1, wherein the inlet extends the full axial length of the conical portion and partially into the lower cylindrical water outlet portion.

3. The cyclone separator according to claim 1, wherein the open bottom extension sleeve portion is provided with a spaced distribution of holes along the open bottom extension sleeve portion spaced at about even intervals and no farther than about 6" apart.

4. The cyclone separator according to claim 1, wherein the conical vane plate is located about 6 inches from the open bottom of the extension sleeve portion.

5. In combination with a steam drum used to separate a steam/water mixture into steam and water portions, a plurality of extended water level steam/water conical cyclone separators, each of said separators comprising:

a separator housing having a conical portion and an upper cylindrical steam outlet portion connected to the conical portion having a central opening for discharging steam from the separator;

a lower cylindrical water outlet portion connected to the conical portion and having a conical vane plate;

an axially elongated steam/water mixture inlet connected tangentially to the conical portion of the housing; and an open bottom extension sleeve portion for discharging water from the housing and connected to the lower cylindrical water outlet portion such that the conical vane plate is located at an intermediate location between the conical portion and the open bottom extension sleeve portion of the lower cylindrical water outlet portion.

6. The combination according to claim 5, wherein inlets of the steam/water conical cyclone separators extend the full axial length of the conical portion and partially into the lower cylindrical water outlet portion.

7. A cyclone separator for separating steam from water in a steam/water mixture, comprising:

a separator housing having a conical portion and an upper cylindrical steam outlet portion connected to the conical portion having a central opening for discharging steam from the separator;

a lower cylindrical water outlet portion connected to the conical portion and having a conical vane plate;

an axially elongated steam/water mixture inlet connected tangentially to the conical portion of the housing; and an open bottom extension sleeve portion for discharging water from the housing and connected to the lower cylindrical water outlet portion such that the conical vane plate is located at an intermediate location between the conical portion and the open bottom extension sleeve portion of the lower cylindrical water outlet portion;

wherein the open bottom extension sleeve portion for discharging water from the housing is provided with apertures for reducing pressure differential across the cyclone separator conical vane plate.

8. A cyclone separator for separating steam from water in a steam/water mixture, comprising:

a separator housing having a conical portion and an upper cylindrical steam outlet portion connected to the conical portion having a central opening for discharging steam from the separator;

a lower cylindrical water outlet portion connected to the conical portion and having a conical vane plate;

an axially elongated steam/water mixture inlet connected tangentially to the conical portion of the housing; and an open bottom extension sleeve portion for discharging water from the housing and connected to the lower cylindrical water outlet portion such that the conical vane plate is located at an intermediate location between the conical portion and the open bottom extension sleeve portion of the lower cylindrical water outlet portion;

wherein the open bottom extension sleeve portion for discharging water from the housing is provided with apertures about ¼" to no larger than about ½" evenly distributed around an upper portion of the extension sleeve portion but below the location of the conical vane plate for reducing pressure differential across the cyclone separator conical vane plate.

9. In combination with a steam drum used to separate a steam/water mixture into steam and water portions, a plurality of extended water level steam/water conical cyclone separators, each of said separators comprising:

a separator housing having a conical portion and an upper cylindrical steam outlet portion connected to the conical portion having a central opening for discharging steam from the separator;

a lower cylindrical water outlet portion connected to the conical portion and having a conical vane plate;

an axially elongated steam/water mixture inlet connected tangentially to the conical portion of the housing; and an open bottom extension sleeve portion for discharging water from the housing and connected to the lower cylindrical water outlet portion such that the conical vane plate is located at an intermediate location between the conical portion and the open bottom extension sleeve portion of the lower cylindrical water outlet portion;

wherein the open bottom extension sleeve portions of the steam/water conical cyclone separators for discharging water from the housing are provided with apertures for reducing pressure differential across the cyclone separator conical vane plates.

10. In combination with a steam drum used to separate a steam/water mixture into steam and water portions, a plurality of extended water level steam/water conical cyclone separators, each of said separators comprising:

a separator housing having a conical portion and an upper cylindrical steam outlet portion connected to the conical portion having a central opening for discharging steam from the separator;

a lower cylindrical water outlet portion connected to the conical portion and having a conical vane plate;

an axially elongated steam/water mixture inlet connected tangentially to the conical portion of the housing; and an open bottom extension sleeve portion for discharging water from the housing and connected to the lower cylindrical water outlet portion such that the conical vane plate is located at an intermediate location between the conical portion and the open bottom extension sleeve portion of the lower cylindrical water outlet portion;

wherein the open bottom extension sleeve portions of the steam/water conical cyclone separators are provided with a spaced distribution of holes along the open bottom extension sleeve portions spaced at about even intervals and no farther than about 6" apart, the conical vane plates are located about 6 inches from the open bottom of the extension sleeve portions, and the holes are about ¼" to no larger than about ½" and evenly distributed around an upper portion of the extension sleeve portions but below the location of the conical vane plate for reducing pressure differential across the cyclone separator conical vane plate.

* * * * *